US006982430B1

(12) United States Patent
Moscaritolo et al.

(10) Patent No.: US 6,982,430 B1
(45) Date of Patent: Jan. 3, 2006

(54) RADIATION CASE

(75) Inventors: Anthony M. Moscaritolo, Saugus, MA (US); James Claude King, Albuquerque, NM (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/857,378

(22) Filed: May 27, 2004

(51) Int. Cl.
*G21C 19/00* (2006.01)

(52) U.S. Cl. ..... 250/496.1

(58) Field of Classification Search ..... 250/496.1, 250/515.1, 506.1; 376/260, 288
See application file for complete search history.

(56) References Cited

U.S. PATENT DOCUMENTS

| | | | | |
|---|---|---|---|---|
| 3,353,023 A | * | 11/1967 | Lowery et al. | 250/506.1 |
| 3,932,777 A | | 1/1976 | King | 310/8 |
| 4,311,938 A | | 1/1982 | Ballato | 310/311 |
| 4,865,801 A | * | 9/1989 | Brahm et al. | 376/260 |
| 4,956,047 A | | 9/1990 | Harris | 156/623 |
| 5,167,079 A | | 12/1992 | Bowen | 34/60 |
| 5,226,065 A | | 7/1993 | Held | 378/64 |
| 5,416,334 A | * | 5/1995 | Knapp et al. | 250/515.1 |

* cited by examiner

*Primary Examiner*—Nikita Wells
*Assistant Examiner*—Zia R. Hashmi
(74) *Attorney, Agent, or Firm*—John Tarlano

(57) ABSTRACT

A radiation case having a radiation-proof door, and having a radiation-proof main section that has a back portion, a floor portion, a ceiling portion and side portions, vertical cavities formed in the back portion, the vertical cavities being a distance from a surface of a back wall of the back portion, radiation rods located in the vertical cavities, each radiation rod containing cobalt-60 pellet, the distance between the vertical cavities and the surface of the back wall of the back portion being less than a penetration distance for gamma rays coming out of each cobalt-60 pellet.

4 Claims, 2 Drawing Sheets

RADIATION CASE

The present invention relates to radiation case. The radiation case can be used to irradiate a quartz crystal with gamma rays. Radiation rods are located in vertical cavities of the radiation case. Each radiation rod holds a radioactive pellet. The quartz crystal is irradiated in a radiation chamber of the radiation case, by gamma rays emitted from a radioactive pellet in each of the radiation rods.

The vertical cavities are precisely positioned in the radiation case. The vertical cavities are formed so as to be in close proximity to a back wall of a back portion of the radiation case. A thin partition is formed between the vertical cavities and the back wall of the back portion of the radiation case.

Again, each of the radiation rods contains a radioactive pellet. The radioactive pellets emit gamma rays. The gamma rays pass through the thin partition of the radiation case, and into a radiation chamber of the radiation case. The gamma rays can then pass into the quartz crystal, to dislodge positive ions interstitially located in the quartz crystal.

The radiation case has a door and extended main section. The extended main section has a back portion, a floor portion, a ceiling portion, and side portions. The door, back portion, a floor portion, a ceiling portion, and side portions form a radiation chamber.

Vertical cavities are formed near to the back wall of the radiation chamber. A thin partition is formed between the vertical cavities and the back wall of the radiation chamber. The vertical cavities are designed to hold radiation rods. The thin partition is thin enough, so that gamma rays, that are emitted from the radiation rods, can pass from the vertical rods and into the radiation chamber.

One of the side portions of the main section has an channel through which an electrical cable and a vacuum hose pass, from beneath the radiation case, into the radiation chamber. The electrical cable and a vacuum hose are connected to an apparatus that is placed in the radiation chamber. The apparatus hold a quartz crystal that is irradiated within the chamber.

A dolly supports the apparatus. The dolly allows the apparatus to be quickly moved into and out of the radiation chamber. The apparatus has an ion pump coupling. The ion pump coupling is connected to the vacuum hose. The apparatus has two electrodes for holding a quartz crystal. One of two electrodes is supported by a frame of the apparatus. Electrical conductor lines, that are in the electrical cable, are connected to the two electrodes.

The door of the radiation case is quickly opened to place the dolly into the radiation chamber. Then the door is quickly closed, to prevent any undue amount of external radiation exposure.

SUMMARY OF THE INVENTION

A radiation case, comprising a radiation-proof door; and a radiation-proof main section, the radiation-proof main chamber section comprising a back portion, a floor portion, a ceiling portion and side portions, vertical cavities formed in the back portion, the vertical cavities being a distance from a surface of a back wall of the back portion, radiation rods located in the vertical cavities, each radiation rod containing cobalt-60 pellet, the distance between the vertical cavities and the surface of the back wall of the back portion being less than a penetration distance for gamma rays coming out of each cobalt-60 pellet.

DESCRIPTION OF THE PREFERRED EMBODIMENT

Figure 1:
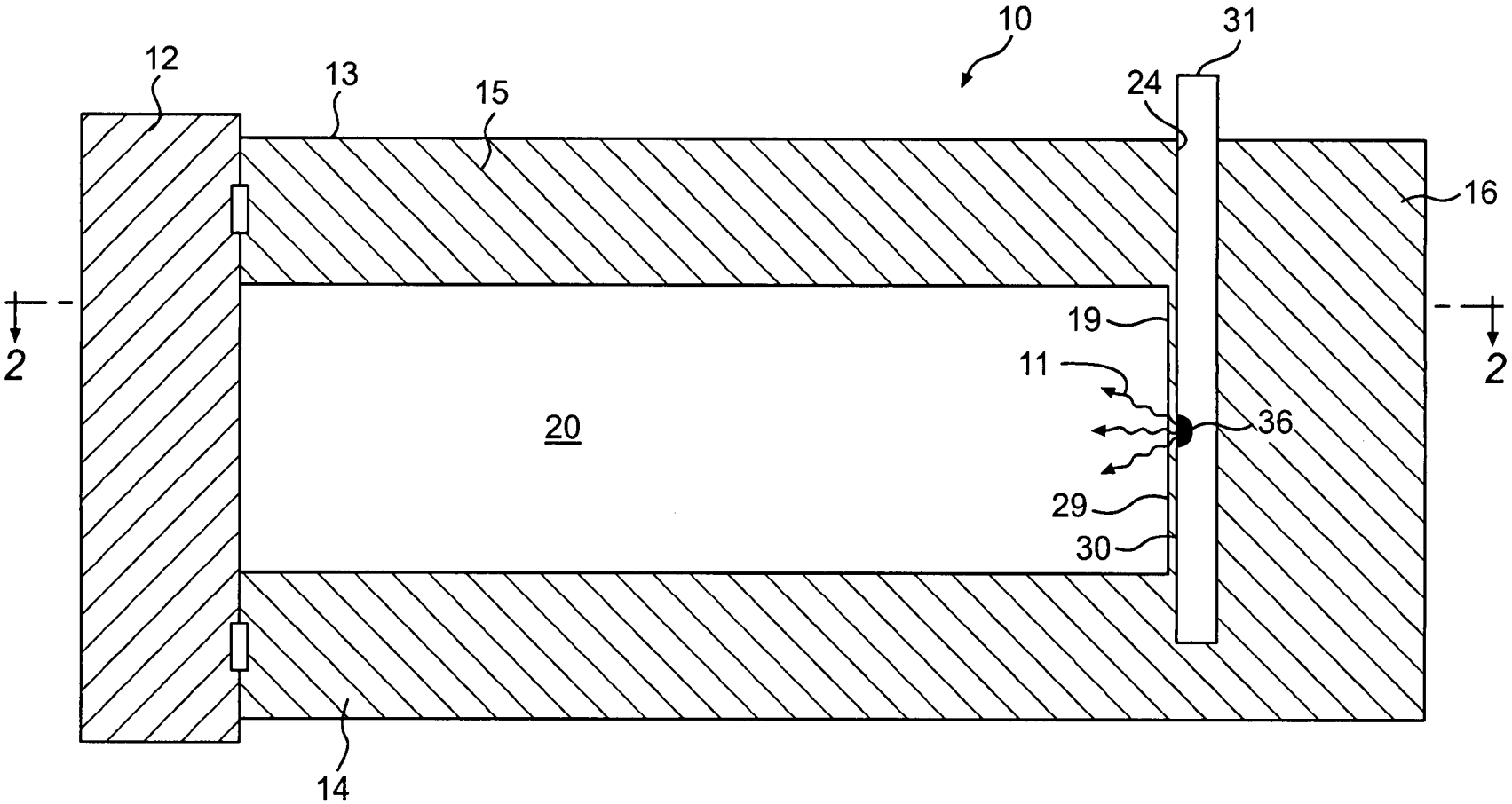
FIG. 1 is a side sectional view of the radiation case.

FIG. 1 shows a sectional side view of a radiation case 10. The radiation case 10 has a radiation proof door 12 and a radiation proof main section 13. The radiation case 10 can contain gamma rays, such as gamma rays 11, that are within radiation case 10. The radiation-proof door 12 and radiation-proof main section are preferably made from a lead metal.

The radiation-proof door 12 can be quickly opened and quickly closed. The quick opening and closing of door 12 prevents an escape of an undue number of gamma rays from radiation case 10.

Figure 2:
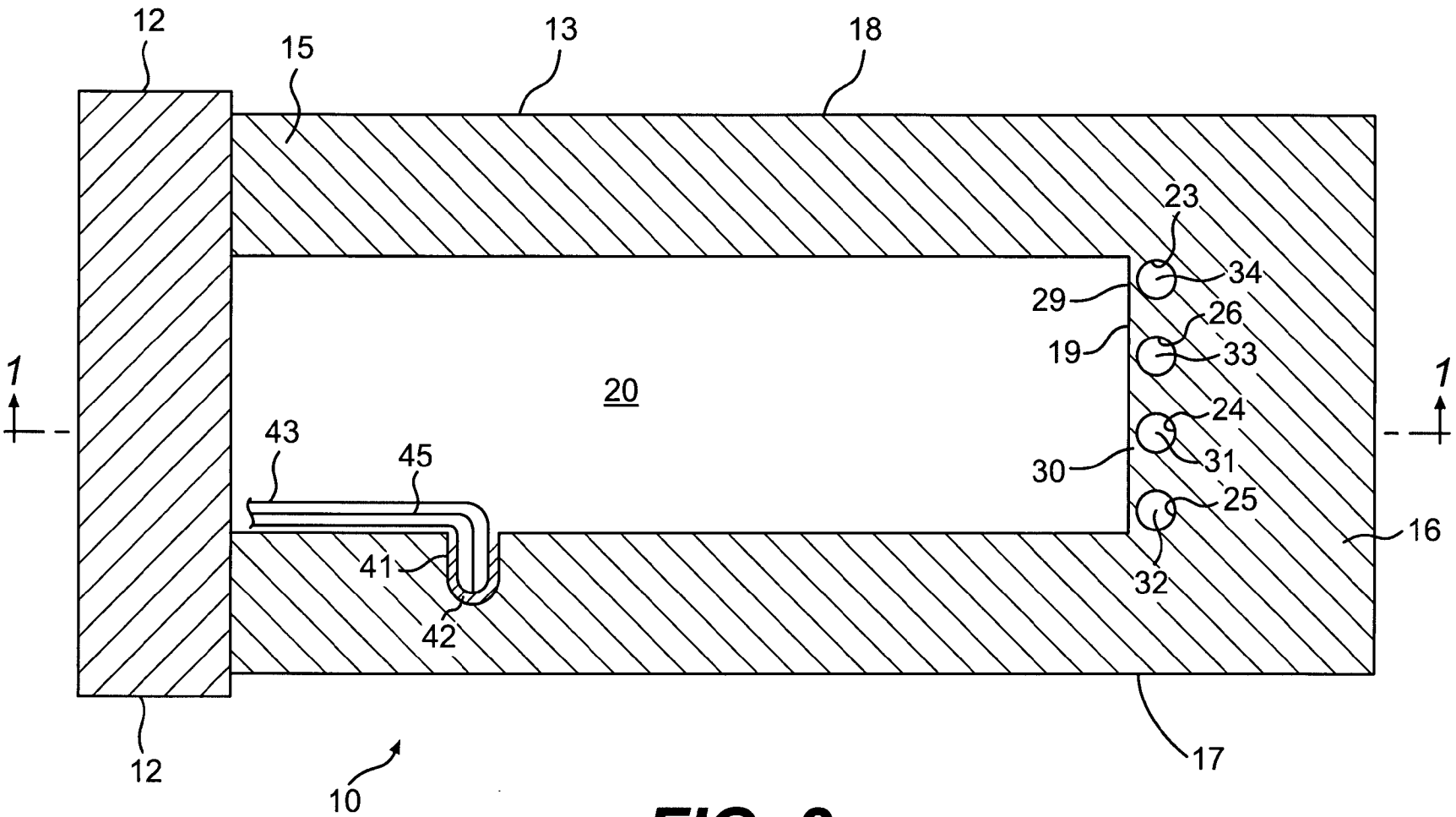
FIG. 2 is a top sectional view of the radiation case.

The radiation-proof main section 13 has a floor portion 14, a ceiling portion 15, a back portion 16, and side portion 17 and 18 shown in FIG. 2. The door 12, floor portion 14, ceiling portion 15, back portion 16, and side portions 17 and 18, form a radiation chamber 20. The radiation chamber 20 is positioned within the radiation case 10. Gamma rays are held within the radiation chamber 20 of radiation case 10, when door 12 is closed.

The back portion 16 is extended away from the door 12 of the radiation case 10, to prevent an escape of an undue number of gamma rays from the chamber 20 of radiation case 10, when door 12 is open. Since the main section 13 is extended, a lesser number of gamma rays will come out of the radiation case 10 from the back portion 16 of the radiation case 10, when door 12 is open.

The back portion 16 has a back wall 19. Aligned, cylindrical, vertical cavities, such as vertical cavity 24, are formed in the back portion 16. Such vertical cavities 23, 24, 25 and 26 are shown in FIG. 2. The vertical cavities are positioned close to the back wall 19, within the back portion 16 of radiation case 10. Between a surface 29 of the back wall 19 and the vertical cavities is a thin partition 30. The partition 30 is thin enough to allow gamma rays, such as gamma rays 11, to pass through partition 30 and into chamber 20.

A separate cylindrical radiation rod is placed into each of the cylindrical, vertical cavities. Cylindrical radiation rod 31 is tightly placed into cylindrical, vertical cavity 24. As shown in FIG. 1, the radiation rod 31 holds a radioactive pellet 36 near its longitudinal center. The radioactive pellet 36 is made from cobalt-60. The cobalt-60 pellet 36 emits gamma rays 11. Each of the radiation rods 31, 32, 33 and 34 holds a cobalt-60 pellet. Each pellet emits gamma rays.

The cylindrical, vertical cavities are located 0.2 centimeters from the surface 29 of the back wall 19 of back portion 16. The cavities are formed in the back portion 16 so that a 0.2 centimeter thick partition 30 is formed in back portion 16. The 0.2 thick partition 30 is thin enough to allow 1.173 Mev gamma rays from a cobalt-60 pellet to pass from a cavity into radiation chamber 20. The cavities are aligned to be parallel to the surface 29 of the back wall 19. A selected distance between the vertical cavities and the surface 29 of the lead back wall 19 is made to be less than a maximum penetration distance through partition 30, for gamma rays coming out of the cobalt-60 pellets in the radiation rods.

Again, FIG. 2 shows a sectional top view of radiation case 10. FIG. 2 shows side portions 17 and 18 of radiation case 10. FIG. 2 shows cavities 23, 24, 25 and 26 of radiation case 10. Radiation rods 34, 31, 32 and 33 are positioned, respectively, in the vertical cavities 23, 24, 25 and 26. Each of the radiation rods holds a cobalt-60 pellet.

FIG. 2 shows a narrow channel 41 that is located in side portion 17. An electrical cable 43 and vacuum hose 45, from vacuum equipment and electrical power equipment located below the case 10, pass through the channel 41. The channel 41 are filled with a lead based sealer 42, to keep gamma rays from passing through channel 41.

While the present invention has been disclosed in connection with the preferred embodiment thereof, it should be understood that there may be other embodiments which fall within the spirit and scope of the invention as defined by the following claims.

What is claimed is:

1. A radiation case, comprising:

(a) a radiation-proof door; and (b) a radiation-proof main section, the radiation proof main section comprising a back portion, a floor portion, a ceiling portion and side portions, vertical cavities formed in the back portion, the vertical cavities being a selected distance from a surface of a back wall of the back portion, radiation rods located in the vertical cavities, each radiation rod containing a cobalt-60 pellet, the selected distance between the vertical cavities and the surface of the back wall of the back portion being less than a maximum penetration distance for gamma rays coming out of each cobalt-60 pellet.

2. A radiation case, comprising:

(a) a lead door; and (b) a lead main section, the lead main section comprising a lead back portion, a lead floor portion, a lead ceiling portion and lead side portions, vertical cavities formed in the lead back portion, the vertical cavities being a selected distance from a surface of a back wall of the lead back portion, radiation rods located in the vertical cavities, each radiation rod containing a cobalt-60 pellet, the selected distance between the vertical cavities and the surface of the back wall of the lead back portion being less than a maximum penetration distance for gamma rays coming out of each cobalt-60 pellet.

3. A radiation case, comprising:

(a) a lead door; and (b) a lead main section, the main section comprising a lead back portion, a lead floor portion, a lead ceiling portion and lead side portions, vertical cavities formed in the lead back portion, the vertical cavities being a distance of 0.2 centimeters from a surface of a back wall of the lead back portion, radiation rods located in the vertical cavities, each radiation rod containing a cobalt-60 pellet.

4. The radiation case of claim 1, a channel being in the side portion of the radiation-proof main section, an electrical cable and a vacuum hose passing through the channel.

* * * * *